US006257212B1

(12) United States Patent
Hammond

(10) Patent No.: US 6,257,212 B1
(45) Date of Patent: Jul. 10, 2001

(54) MECHANICAL FUEL GASIFICATION

(76) Inventor: Rudy W. Hammond, 106 Brewton Ct., Anderson, SC (US) 29621

( * ) Notice: Subject to any disclaimer, the term of this patent is extended or adjusted under 35 U.S.C. 154(b) by 0 days.

(21) Appl. No.: 09/666,955

(22) Filed: Sep. 20, 2000

(51) Int. Cl.[7] ..... F02M 31/00
(52) U.S. Cl. ..... 123/557; 123/590
(58) Field of Search ..... 123/590, 592, 123/557

(56) References Cited

U.S. PATENT DOCUMENTS

| | | | | |
|---|---|---|---|---|
| 354,204 | | 12/1886 | McLaughlin . | |
| 434,810 | | 12/1890 | Rogers . | |
| 1,754,828 | | 4/1930 | Kelsall . | |
| 1,778,194 | | 10/1930 | Kreager . | |
| 2,560,799 | | 7/1951 | Johnson . | |
| 2,767,024 | | 10/1956 | Swan . | |
| 2,772,120 | | 11/1956 | Olson . | |
| 3,945,352 | | 3/1976 | Reimuller . | |
| 4,083,340 | | 4/1978 | Furr . | |
| 4,274,598 | | 6/1981 | Wilfert et al. . | |
| 4,320,875 | | 3/1982 | Sutter . | |
| 4,360,161 | | 11/1982 | Claxton et al. . | |
| 4,483,307 | * | 11/1984 | Gilmor | 123/557 |
| 4,515,134 | | 5/1985 | Warren, II | 123/557 |
| 4,603,672 | | 8/1986 | Keller | 123/545 |
| 4,637,365 | | 1/1987 | Yunick | 123/545 |
| 4,981,266 | | 1/1991 | Aichele et al. . | |
| 5,137,005 | * | 8/1992 | Kirby | 123/592 |
| 5,226,400 | * | 7/1993 | Birch | 123/557 |
| 5,271,563 | | 12/1993 | Cerny et al. . | |
| 5,908,475 | * | 6/1999 | Morris et al. | 123/590 |
| 5,924,398 | * | 7/1999 | Choi | 123/590 |
| 5,974,780 | | 11/1999 | Santos . | |

* cited by examiner

*Primary Examiner*—Marguerite McMahon
(74) *Attorney, Agent, or Firm*—Flint & Kim, P.A.

(57) ABSTRACT

A method and apparatus for mechanically gasifying an atomized fuel/air mixture by passing the mixture through intermeshing sets of pins rotating at high speeds. When used in an internal combustion engine, the fuel efficiency is enhanced and undesirable emissions are reduced.

19 Claims, 9 Drawing Sheets

Fig. 8
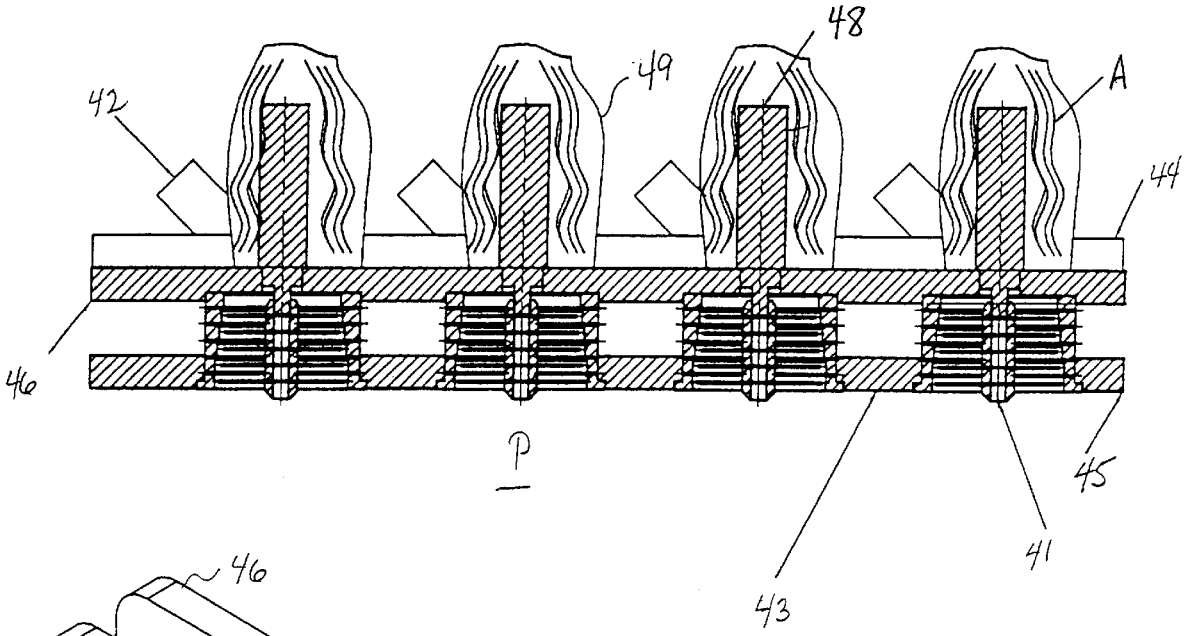
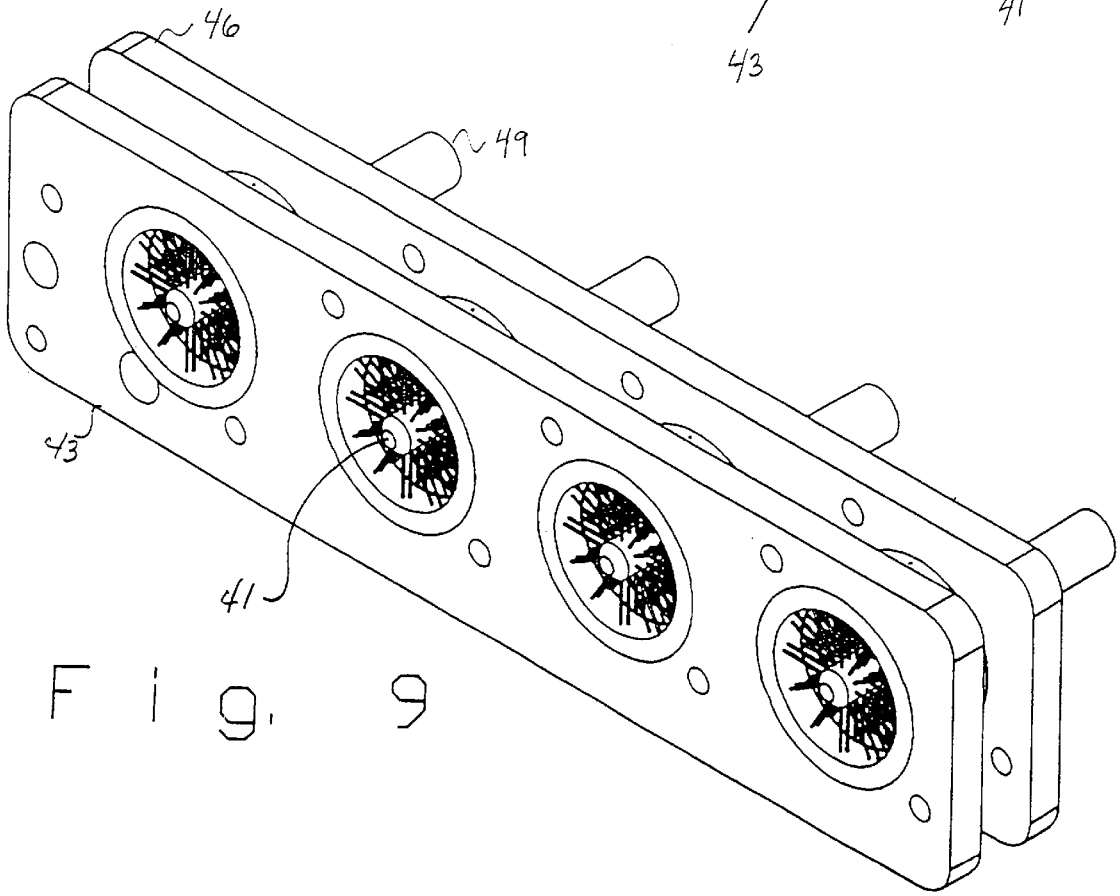
Fig. 9

MECHANICAL FUEL GASIFICATION

FIELD OF THE INVENTION

The present invention relates to a method and apparatus for mechanically gasifying a substantial portion of a liquid fuel for an internal combustion engines thereby providing an improvement in fuel mileage and power and a reduction in undesirable emission products.

BACKGROUND OF THE INVENTION

In the design of internal combustion engines it has long been recognized that achievement of optimum fuel/air mixtures is a principal factor in improving efficiency. The fuel will then be burned as completely as possible. Completely burning the fuel obviously results in extracting the maximum amounts of energy from each gram of fuel and eliminates unburned or partially burned fuel in the engine exhaust which is the source of most undesirable emission products.

In the past, carburetors and fuel injectors generally have provided a fuel/air mixture in atomized or vaporized form. These mixtures tend to consist of finely divided droplets of fuel suspended in air as a vapor. Very little, if any, pure gaseous fuel is produced in the typical prior art carburetor or fuel injector. Generally, designers of carburetors and fuel injectors have attempted to get a finer and more uniform distribution of fuel droplets within the fuel/air mixture. However, as the droplets become finer or smaller in diameter, the droplet surface tension becomes greater and further reduction to a true gaseous state comprising fuel molecules mixed with air molecules becomes difficult to achieve.

The desirability of providing fuel for an internal combustion engine in a pure gaseous or super heated form has been recognized in the prior art. For example, in U.S. Pat. No. 4,083,340 which issued on Apr. 11, 1978 to Clen Furr et al a method of superheating gasoline is described. In the Furr et al method, the heat from the cooling system of an internal combustion engine is used to heat gasoline under pressure in a chamber above the normal boiling point of gasoline. When pressure is reduced, the gasoline is converted to a gas and liquid fuel. The gaseous fuel is fed to the intake of an internal combustion engine and the liquid fuel is recycled back to the fuel pressure chamber. However, this method requires the heating of a highly flammable fuel under pressure with the obvious risk such heating involves. Accordingly, it is one object of the present invention to provide a method and apparatus for producing fuel for an internal combustible engine in a purely gaseous state or a mixture of gas and very fine, invisible droplets without the necessity of heating the fuel.

It is known in the prior art to heat the intake manifolds of an internal combustion engine so that the atomized fuel mixture will be expanded and be more like a true gas as it enters the combustion chamber of the engine. However, heat must be added to the manifold. Accordingly it is another object of the present invention to provide a method and apparatus for converting an atomized fuel into a gaseous state without the addition of heat energy, that is, fuel in a gaseous state or is near that of super heated fuel is provided immediately at the start of engine, with no superheated fuel reservoir required. The gasification units of my invention are at optimum speeds immediately prior to engine ignition because the engine start-up and gasification units can start-up simultaneously.

In another prior art device disclosed in U.S. Pat. No. 4,515,134 to Conrad K. Warren which issued May 7, 1985, a "Molecular Diffuser Assembly" is described in which a thermistor-type heater/evaporator is used to vaporize the volatile constituents of a fuel. When substantially vaporized, the fuel is introduced into a venturi for diffusion into an air stream passing therethrough. The air stream is delivered into the combustion chamber of an internal combustion engine. Again, it is an object of the present invention to avoid the necessity of heating fuel or atomized fuel before delivering it to the combustion chamber of an internal combustion engine.

In the prior art, significant effort has been devoted to reducing the emission products from an internal combustion engine and among these undesirable products are the unburned hydrocarbons and the oxides of nitrogen. In addition to catalytic converters, as one means to reduce these emissions and suppress premature ignition, it is common design practice to equip an engine with an exhaust gas re-circulation valve (EGR.) Another method is to inject water into the atomized fuel/air mixture. These prior art methods and devices require complicated valving and the supply and delivery of another material, namely, water or exhaust gases. Accordingly, it is still a further object of the invention to provide an apparatus and method to reduce the emission of undesirable combustion products without the necessity for water injection and to minimize the need for re-circulation of exhaust gases.

While there have been many other prior art attempts to successfully superheat or gasify fuel in order to provide a more efficient internal combustion engine with reduced exhaust contaminants my invention as described below generally achieves all these objects with a novel method and apparatus.

SUMMARY OF THE INVENTION

In one aspect, the invention is a method for mechanically breaking down the fuel droplets in an atomized vapor such as that provided by a fuel injector or carburetor, by overcoming surface tension forces of the droplets with mechanical turbulent forces. The forces are provided by ultra high speed rotor and stator members through which an atomized fuel mixture is passed on its way to the combustion chambers of an internal combustion engine.

In another aspect, the present invention is an apparatus for mechanically gasifying liquid fuel comprising a housing; a stator body disposed within said housing, the inner surface of said stator having an array of pins inwardly projecting therefrom; a rotor body having an array of pins outwardly projecting from the outer surface thereof; said rotor being mounted for high speed rotation with its pins intermeshing with the stator pins; a drive motor for rotating said rotor at high speeds; a first end cap or first closure means adapted to close the housing at one end thereof and for receiving atomized fuel from an injector and to pass said fuel into said housing so that the atomized fuel passes through the intermeshing pins; and, a second closure means or end cap for closing the other end of said housing and for directing gaseous fuel into the intake manifold or into the intake valves of an internal combustion engine, and then into the combustion or piston firing chamber.

In another aspect, the present invention is a method for mechanically gasifying atomized fuel for an internal combustion engine comprising the steps of receiving atomized fuel from a fuel injector, carburetor, nozzle or other fuel atomizing device, passing said fuel through intermeshing rows of pins where at least one row of pins is rotating at a high speed so that droplets of fuel in said atomized fuel which impinge on the pins forcibly are broken down and are converted into a gaseous or near gaseous/fine droplet state; and, then, conveying said gaseous fuel into the combustion chamber of an internal combustion engine. My invention includes an arrangement whereby the "stator" is disposed for counter-rotary motion so that the relative velocities between pins is significantly increased.

Broadly, my invention is applicable to all types of liquid fuel for internal combustion engines and is most advantageously used in connection with gasoline powered, piston driven engines or with turbine or furnaces, nozzled fire boxes or boilers adapted so that fuel is introduced through nozzles. Special advantages of my invention for internal combustion engine are lowered carbon monoxide and nitrous oxide (NOX) emissions and increased carbon dioxide ($CO_2$) emissions. The oxygen ($O_2$) emissions are approximately zero. Further advantage of my invention will be readily apparent from the reading of the following detailed description of preferred embodiments which are illustrated in the accompanying drawings which are made a part of this specification and are described below.

DESCRIPTION OF THE DRAWINGS

In the drawings which are appended hereto and made a part of this specification:

FIG. 8 is a perspective in elevation showing an arrangement of four gasification units of the invention supported by the original equipment manifold of the engine and positioned to be mounted above the intake valves of an internal combustion engine; and, FIG. 9 is a perspective view of the bottom of the arrangement of FIG. 8.

DETAILED DESCRIPTION

As used herein the terms, "gas" or "gaseous" means a significant reduction in the diameter of fuel droplets and the breaking down of droplets into free molecules. It is to be understood that "gas" or "gaseous" includes a mix of free molecules of fuel and ultra fine fuel droplets. Many pure gasses are visually clear so that gaseous fuel may be characterized by its visual clarity. That is, in a gaseous state, the fuel appears transparent and "invisible" as an insufficient number of droplets are present to create a visible "fog" or "vapor."

Also used herein is the term "high speed" regarding the rotational speed of the rotor in terms of revolutions per minute (rpm). "High speed" refers to rotational speeds from below about 10,000 rpm or less to above about 100,000 rpm.

Figure 3:
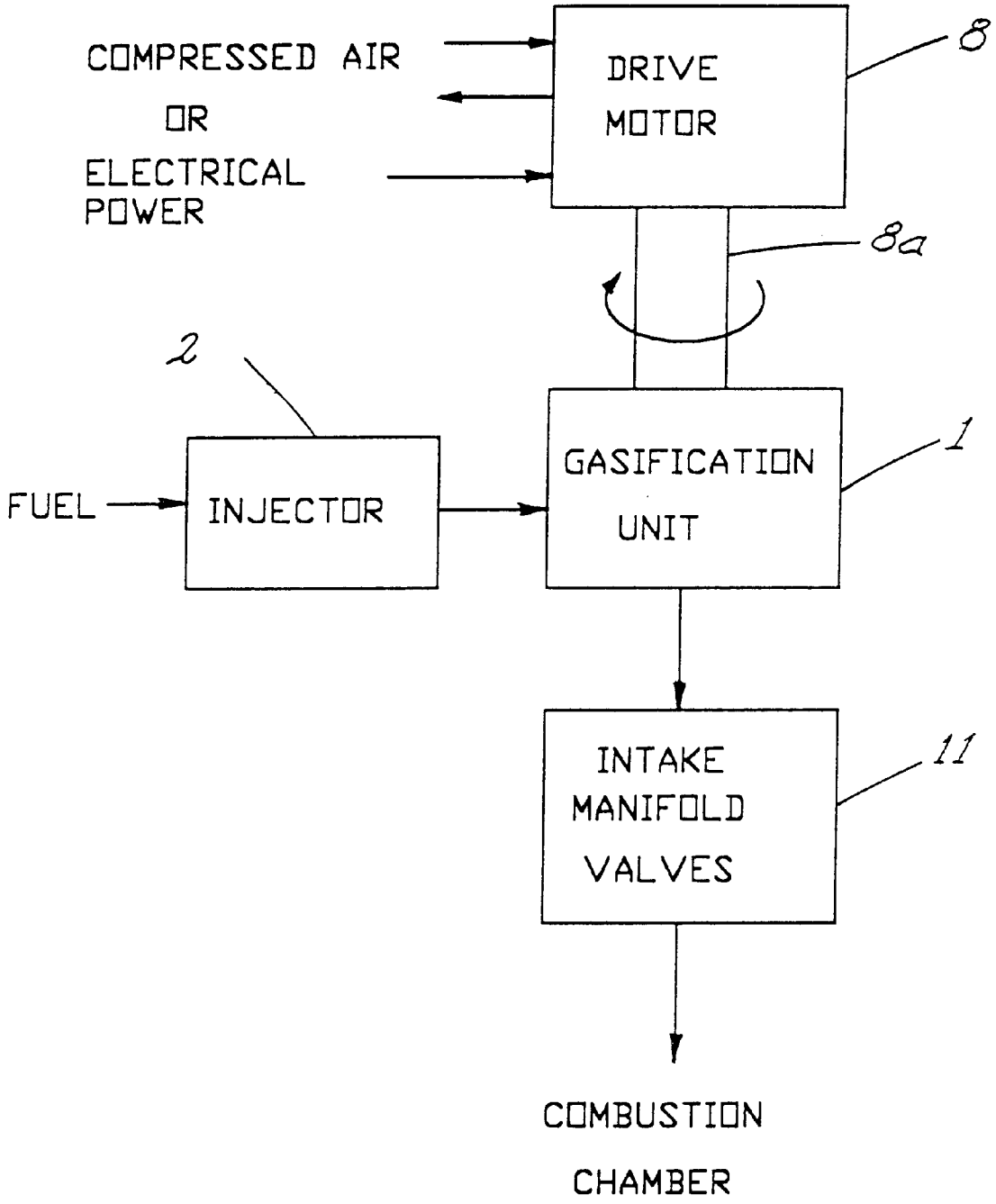
FIG. 3 is a block diagram representing steps or stages in performing one embodiment of my invention.

Looking first at FIG. 3, a block diagram of one preferred arrangement for an internal combustion gasoline engine for an automobile is shown. In a typical modern automobile, fuel is pumped from the gas tank by an electrically or mechanically driven fuel pump to a fuel rail which distributes fuel to the fuel injectors. Each cylinder of the engine is provided with a fuel injector. A injector may be of the type shown and described in U.S. Pat. No. 5,271,563 which issued on Dec. 21, 1993 to Mark Cerny et al and is assigned to the Chrysler Corporation. After leaving the injector in an atomized state, the fuel enters the gasification unit of the present invention which is driven by a ultra high speed motor capable of rotating at speed of 50,000 RPM. The motor may be driven by compressed air or by the exhaust gas, or, preferably by an electrical motor. After leaving the gasification unit the now gasified fuel enters the intake manifold where it is drawn through the valves and then into the combustion chamber to be burned.

Figure 1:
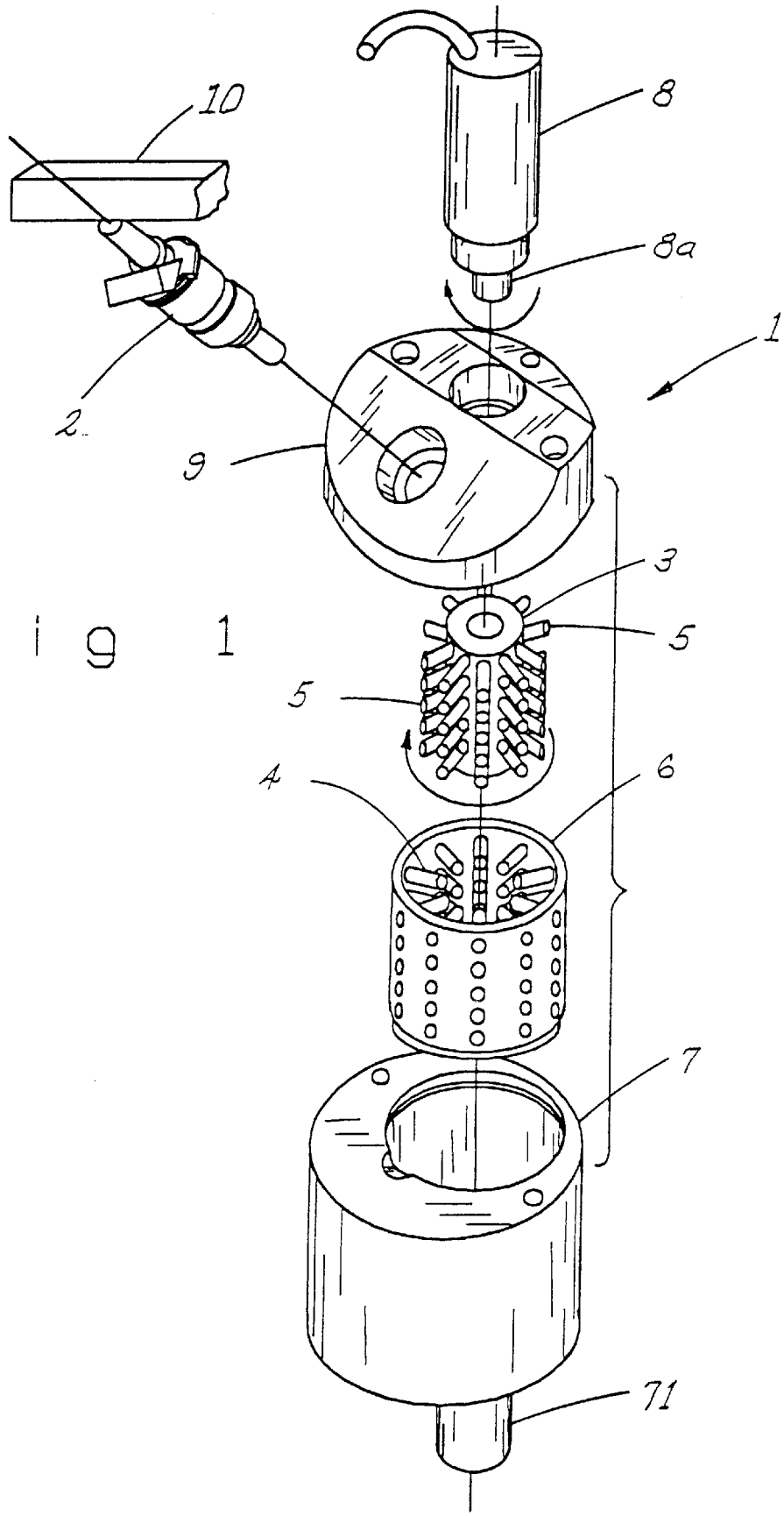
FIG. 1 is an exploded perspective representation of a preferred embodiment of the present invention showing its position between a fuel injector and an intake manifold.

Turning now to FIG. 1, a preferred embodiment of the gasification unit of my invention will be described. Gasification unit 1 comprises generally cylindrical housing body 7 which is open at both ends and is of a length and diameter that will readily fit within an internal combustion engine between the fuel injector and the intake manifold. Disposed within the housing body is a stator 6 which also is of a generally cylindrical shape that fits within the cylindrical cavity of the housing 7 securely so that it will not rotate. It is coaxially aligned within the housing and within the stator. On the inner surface of the stator are inwardly projecting stator pins 4 and in the preferred embodiment there are five rows of these pins distributed around the inner surface of the stator with twelve pins per row. The number of rows of pins can vary to conform to the requirements of each engine type and size.

Still referring to FIG. 1, the rotor body is positioned for rotating motion within the stator body and has a corresponding array of rotor pins 5. Five rows of pins and twelve pins per row which are arranged to intermesh between the stator pins when the rotor is rotated. End cap 9 closes the top of housing body 7 with the rotor 3 and stator 7 enclosed therein. End cap 9 has a central opening through which the drive shaft 8*a* of motor 8 passes and is connected to rotor 3 so that the motor may drive it in rotary motion. The end cap's center most opening through which the shaft 8*a* passes further comprises a bearing surface in which the motor shaft 8*a* is journaled. (Not shown in detail).

In a preferred embodiment a pneumatic vane motor, model MMF-5000 from Micro Motor of Santa Ana, Calif. is used to drive the rotor. This motor will turn at about 50,000 rpm. A more preferred motor is an electrically driven motor that will turn the same or higher rpm. However, depending upon the specific embodiment and application, the desired rpm can vary as much as 50,000 rpm.

End cap 9 has a second orifice or opening which is adapted to receive the discharge nozzle of fuel injector 2 which supplies the atomized fuel. At the other end of the housing 7 the bottom end cap or closure 7*a* is provided to close the housing and deliver fuel to the intake manifold or fuel collection chamber where the gasified fuel will be drawn into the cylinder of the internal combustion engine when its intake valves open.

Figure 2:
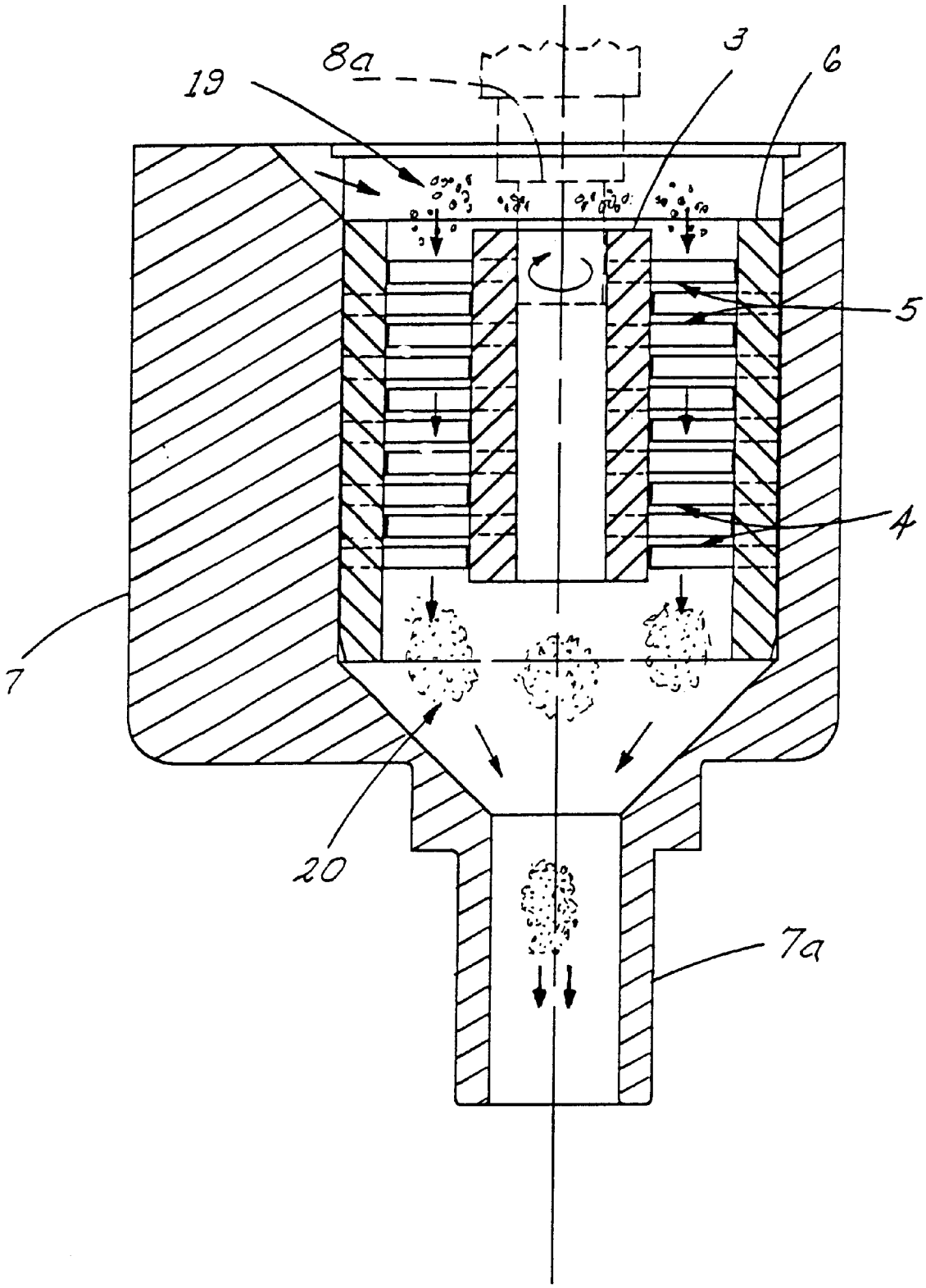
FIG. 2 is a cross-section in elevation through the assembled embodiment of FIG. 1 showing the intermeshing rotor and stator pins with the atomized fuel passing therethrough in one embodiment of my invention.
Figure 2A:
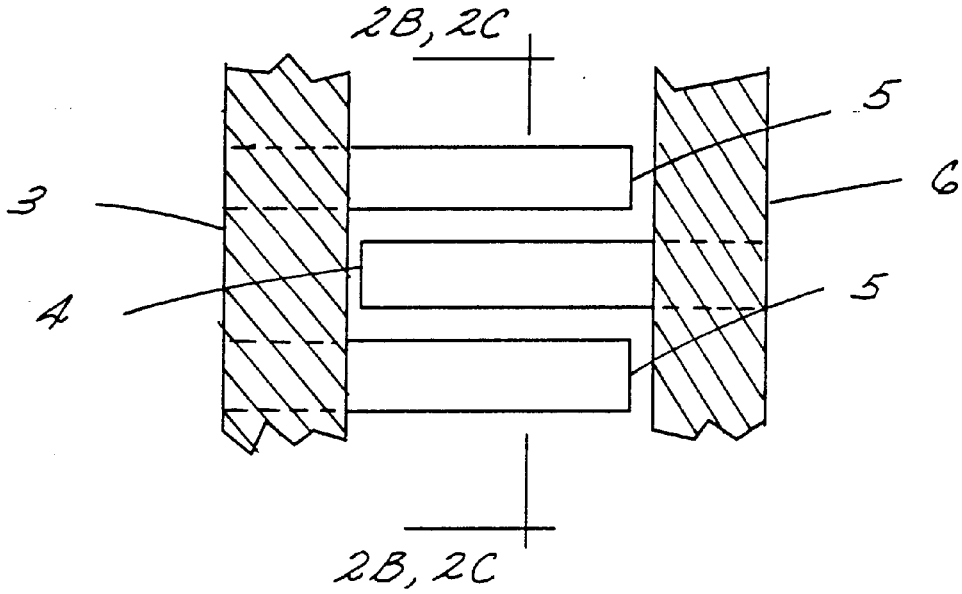
FIG. 2A is an enlarged segment of FIG. 2 showing the pin configuration in detail.

Looking now at FIG. 2, the gasification unit is shown in a representative partial section to show the intermeshing pins. Rotor body 3 is held in position by drive shaft 8*a* and the pins 5 which outwardly project from its outer surface intermesh with the pins of the stator 6 which inwardly project from its inner surface. Atomized fuel 19 enters from the fuel injector and passes between the pins rotating at high speed. Gasification occurs as the atomized fuel mixture 9 passes through the rotating pins and exits as gasified fuel 20. The dimension of a preferred embodiment of a single unit are set out in Table I below in inches:

TABLE I

| | |
|---|---|
| Rotor Shaft Diameter | 0.250" |
| Pin Diameter | 0.0625" |
| Rotor pin length | 0.3750" |
| Tip to Tip diameter | 1.00" |
| Rotor Height | 1.25" |
| Stator Diameter (interior) | 1.040" |
| Stator Pin Length | 0.25" |
| Stator Height (bottom to top) | 1.00" |

The above dimensions are those for the tested embodiment. The pin-to-pin clearance can vary from about 0.01" to as much as about 0.060 inches. Also, the shape of the pins may be varied, and, be oval, square, or rectangular cross section and may be provided with varying thickness along their lengths. The round cross-section as shown generally in the drawings is believed to have the advantage of providing a surface which is less likely to collect unwanted deposits and provides a more aerodynamically advantageous shape, that is, such a shape will strike droplets with maximum momentum and energy with least aerodynamic drag.

Figure 2B:
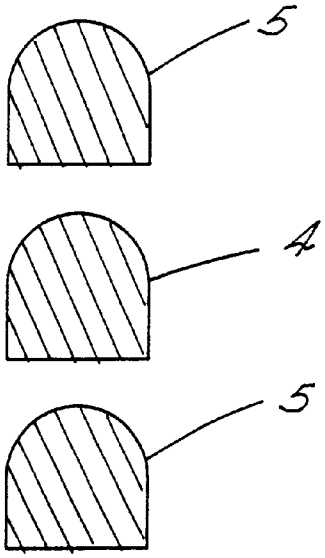
FIG. 2B is a cross-section view of an alternate pin configuration along line 2B—2B of FIG. 2.
Figure 2C:
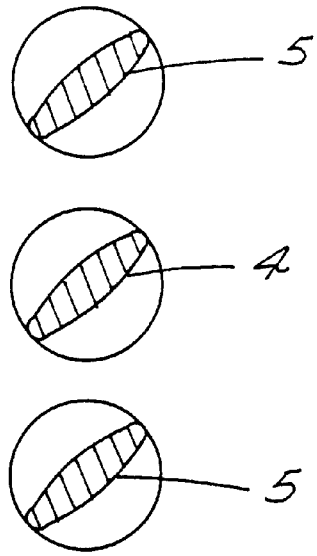
FIG. 2C is a cross-section of an alternate pin with a propeller like twist along the lines of 2C—2C of FIG. 2.

Alternate pin shapes, however, are within the scope of my invention. These are shown in FIGS. 2B and 2C. FIG. 2B shows the cross-section of a pin which is flat on one side and rounded on the other, pins 5 being rotor pins and pins 4 being stator pins. The flat faced pin has the advantage that the surface will strike droplets at angles which impart maximum momentum and energy and reduce "glancing" collisions. The propeller-twist shape of FIG. 2C can serve to promote higher turbulence within the gasification unit thus increasing the number of collisions between droplets and pins. Pins 5 are rotor pins and pins 4 are stator pins. It can be advantageous to arrange all three shapes on the rotor in various patterns to create maximum turbulence and droplet size reduction.

First Preferred Embodiment

Figure 4:
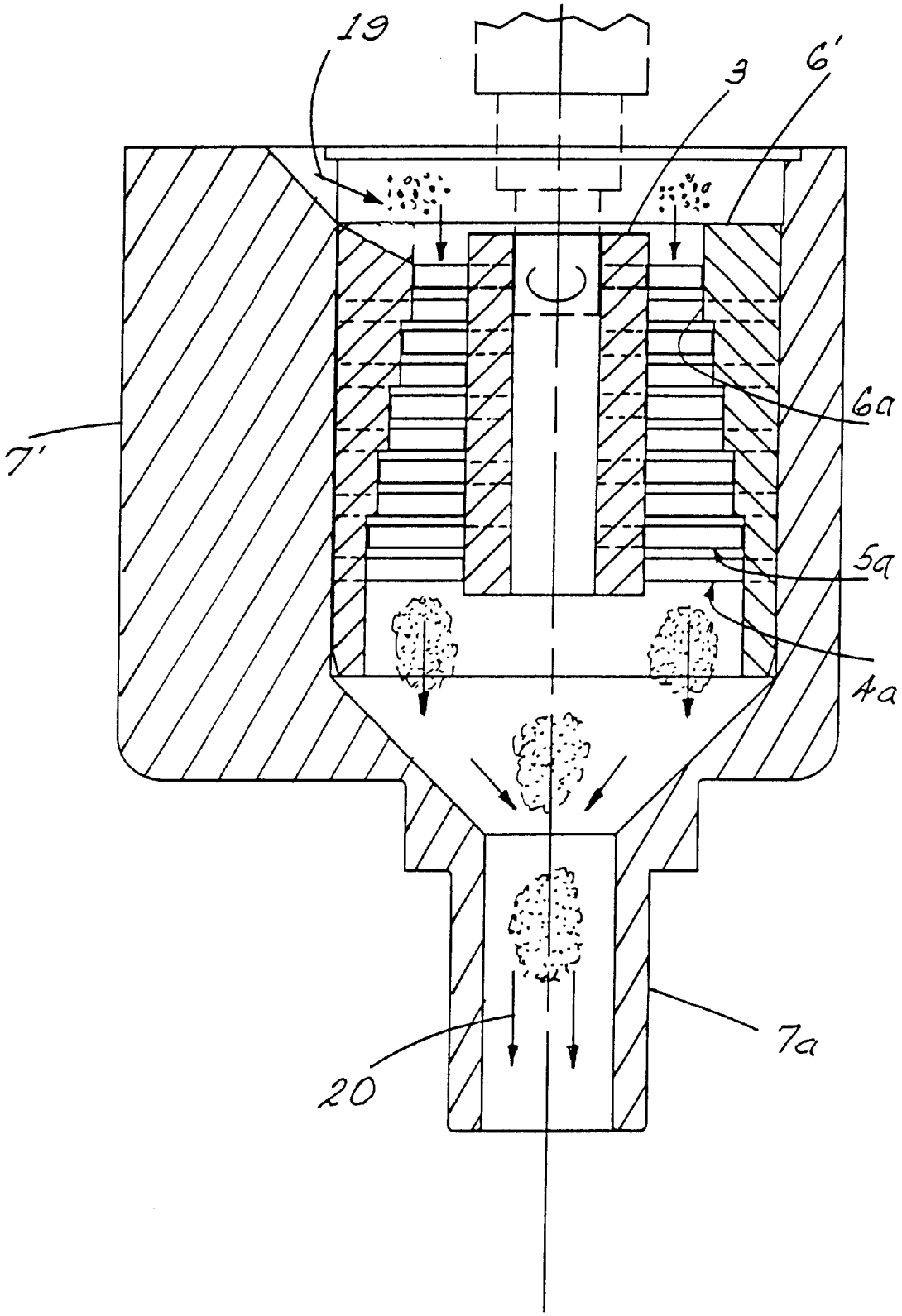
FIG. 4 is a view similar to that of FIG. 2 but showing a alternate embodiment of the invention which includes a stepped wall interior surface of the apparatus of the invention with pins having corresponding stepped lengths.

In a first preferred embodiment which is shown in FIG. 4 the stator body 6' in the interior of the housing has surface 6*a* from which said stator pins 4*a* project; and, body 6' is stepped from top to bottom with the smaller diameter where surface step 6*a* is indicated at the top so that gasoline which might condense on the surface will drip down, and be struck by the rotating pins 5*a* below. That is, there is no place for liquid fuel to collect in this embodiment so all fuel becomes gasified as it cannot escape the rotating pins and will be gasified.

While my intention is not to be held to any particular theory of why the gasification occurs, it is my current belief the atomized droplets in the incoming fuel mixture from the fuel injector are struck numerous times by the high speed rotating pins which rotate at such speeds that no droplet can pass through the gasification unit without being struck repeatedly by the pins. These pins have sufficient kinetic energy and momentum so that when striking fuel droplets the energy is great enough to rupture the surface tension of a droplet and break it into even finer droplets. As the droplets are divided, in each breaking down collision, molecules of fuel are released and do not recombine into droplets because the motion imparted overcomes this tendency. Thus a true gas develops which is comprised of freely moving molecules of fuel and air. Rather than using thermal energy to produce a gas kinetic energy is used.

The fuel flow to each cylinder of an internet combustion gasoline engine is an infinitesimally small injection of fuel per power stroke. For example, a 4 cylinder 1992 Honda Accord EX 2.2 liter engine gets approximately 25 mpg at 60 mpg under normal load highway conditions. At this speed, the engine is turning 2,200 rpm and at that speed will be firing an average of 73.33 times per second, 4400 times per minute or 264,000 times per hour, and will consume (2.4/264,000) 0.00000909 gallons per power stroke (injection) or 0.0000545 pounds per power stroke (injection.)

With each injection of fuel being so small, converting each injection of fuel from liquid vapor state to a superheated or gasified state is made possible using high speed turbulence produced by mechanical equipment. Also, the process is aided by the normal intake manifold vacuum.

EXAMPLE ONE

In one test of the first preferred embodiment, a 1992 Honda Accord, having a four cylinder fuel injected engine was equipped with four of the gasification units of the embodiment of FIG. 1. These units were positioned between the fuel injectors and the intake manifold for each cylinder. Prior to installing the gasification units, in a gas mileage test over a course of 12 miles, the gasoline consumed was at the rate of 25 miles per gallon. After installing the gas units of the invention and repeating the same course at the same speeds and under the same conditions gas mileage improved to 35 miles per gallon. Also, engine performance noticeably improved as the engine accelerated the car noticeably better.

In still another embodiment of the invention, the gasification unit is divided into stages whereby the rotor, stator, and housing of the first stage are of a smaller diameter than that of the corresponding parts of the second stage. The first stage feeds directly to the second stage and provides expansion as the fuel becomes gasified.

Second Preferred Embodiment

Figure 5:
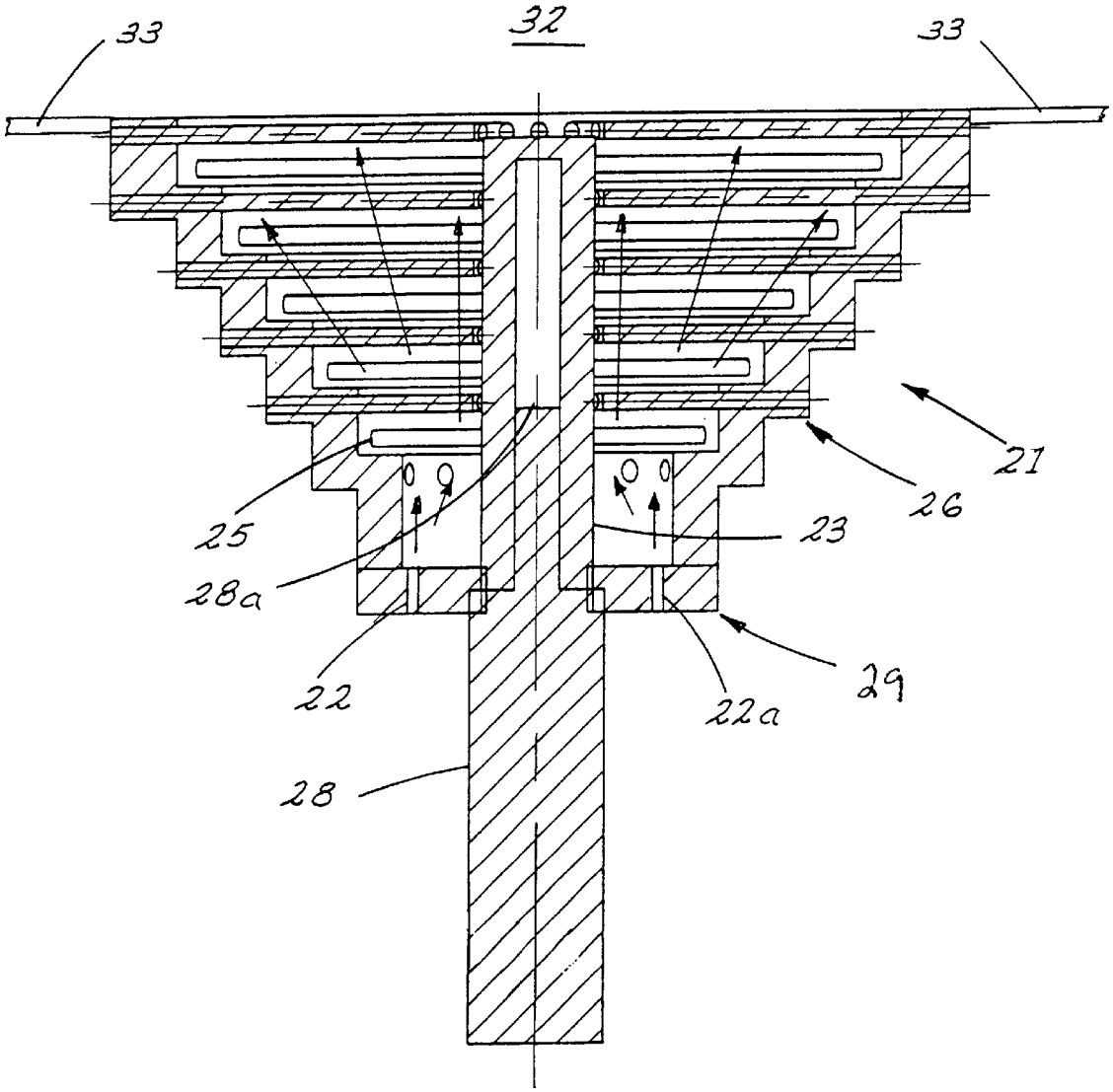
FIG. 5 is a cross-sectional view of a second alternate embodiment of the invention which is adapted to be mounted directly on a manifold or firewall.
Figure 6:
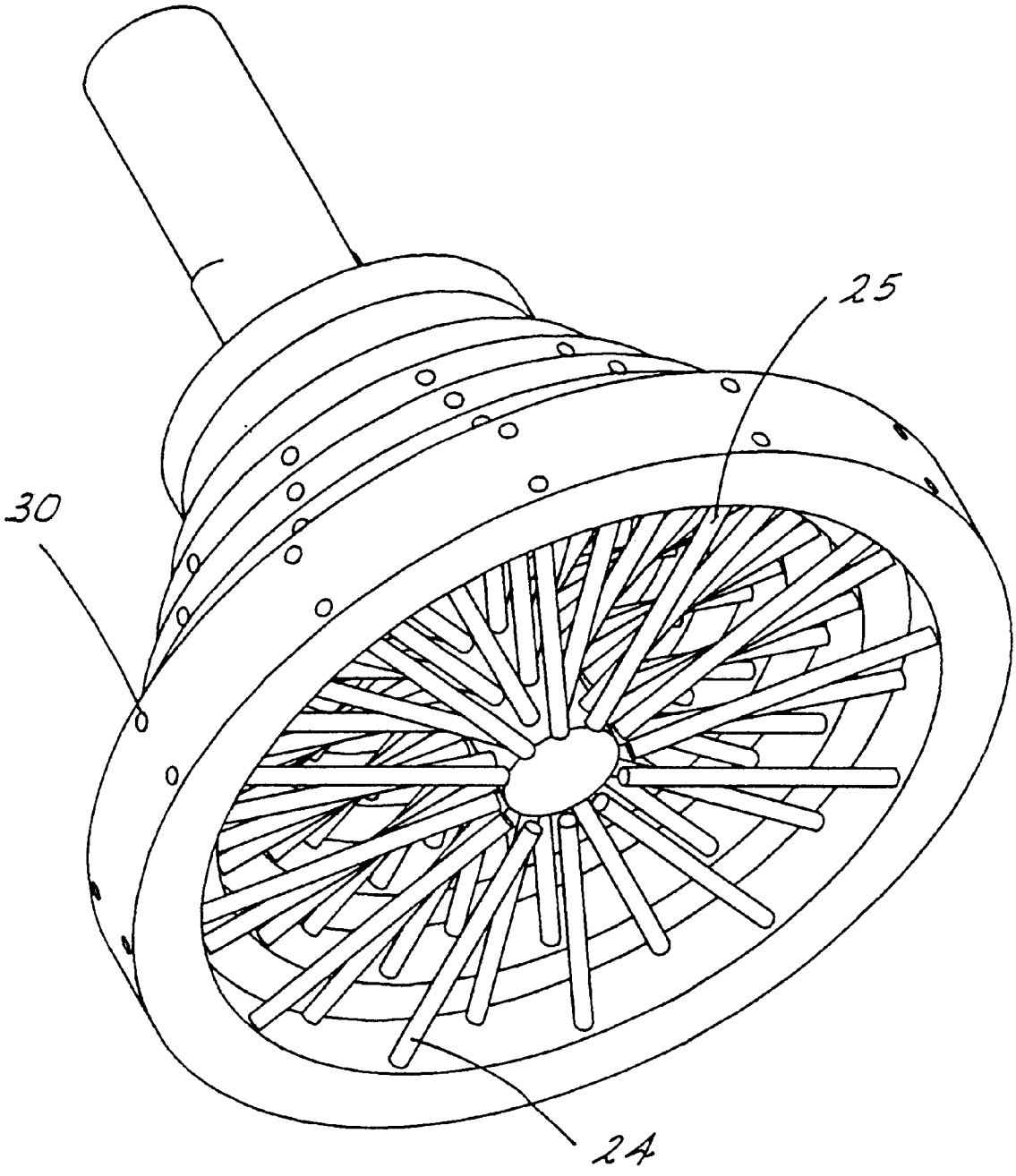
FIG. 6 is a perspective view of the embodiment of FIG. 5 from the discharge end.
Figure 7:
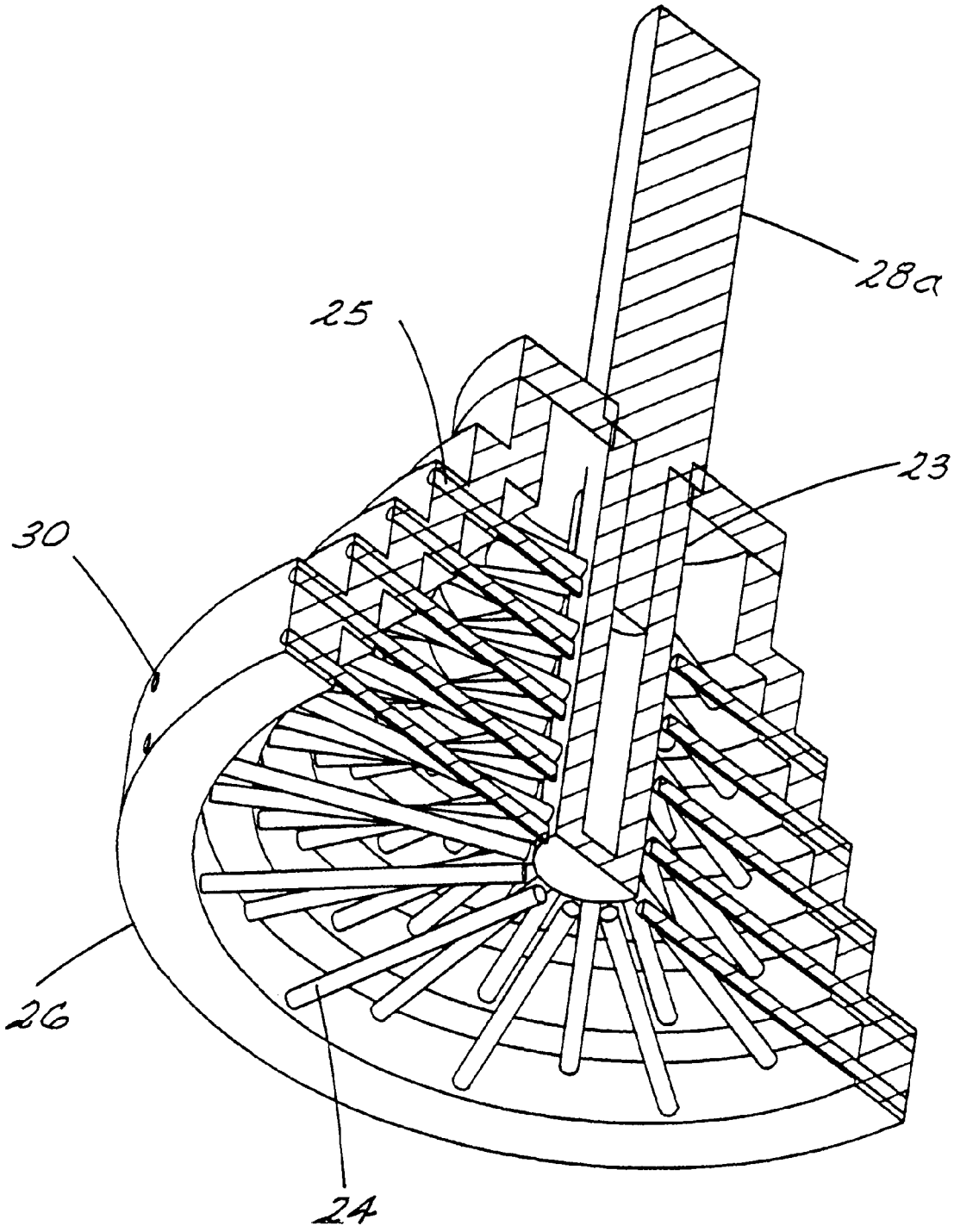
FIG. 7 is a cross-section in perspective of the embodiment shown in FIG. 6.

Referring now to FIGS. 5, 6, and 7, a second preferred embodiment will be described which is a novel gasification unit for various type fuel nozzles for turbine engines, boiler fire boxes, furnace fire boxes, or any burner system where the fuel is supplied by nozzles. The gasification unit 21 is mounted on firewall 33 of combustion chambers 32. In this configuration, unit 21 is disposed within an enclosed housing (not shown) to which a source of compressed air is supplied. The space between the housing and the firewall forms a pressurized air chamber. Fuel is injected from a fuel injector through nozzles 22, 22*a*.

The motor 28 for this embodiment is a very high RPM motor which provides further droplet breakdown and gasifies all the spherical fuel droplets developed in the fuel nozzle spray, regardless of how small they are.

The drive motor's shaft 28*a* extends about 1.5" beyond the motor housing 28 to carry the rotor sleeve 23 that is bored to match the shaft 28*a* diameter so the rotor sleeve 23 can be pressed onto the shaft 28*a* and secured to the shaft to the required depth, at which the centerline of the rows of rotating pins are separated from the centerline of the rows of stator pins 24 by about 0.1875" to insure there is no contact during operation. This separation can and will vary for alternate embodiments of my invention.

Respectively, the rotating rows of pins on the rotor are separated from each other by about 0.375". Also, the stationary rows of pins on the stator are separated by about 0.375". It is understood that all of these rows of pins may be further separated or narrowed as machinery and assembly tolerances allow.

At each successive step of rows of pins, the length of both the rotating and stationary pins is increased about 0.25" progressing from the first row to the fifth row. These pin lengths, diameter and shape will vary as the applications vary.

The first through the fifth rows of rotating pins have the following lengths:

| | |
|---|---|
| 1st Row | 0.825" |
| 2rd Row | 1.075" |
| 3rd Row | 1.325" |
| 4th Row | 1.575" |
| 5th Row | 1.825" |

Preferably, the gap between the end of a pin and the stator housing, for each step is 0.05", or greater, to prevent fuel droplets from escaping around rotating pins.

The first through the fifth stationary pin lengths are as follows:

| | | |
|---|---|---|
| 1st Row | | 1.200" |
| 2nd Row | | 1.450" |
| 3rd Row | | 1.700" |
| 4th Row | | 2.075" |
| 5th Row | (No Step) | 2.075" |

Preferably the gap between end of the stationary pins and the rotating sleeve is also 0.050" clearance. This small clearance insures that each droplet broken down by the rotating pins must come in contact with the stationary pins, due to their close proximity to each other. Also, these stationary pins eliminate any tendency towards vortexing or cavitation which might be caused by the rotating pins. The fuel droplets, at high velocity either bounce off the rotating pins or are fragmented into smaller droplets all of which will strike the stationary pins, causing even further fragmentation of the droplets.

This process repeats itself through all five sets of pins, with the fuel leaving the fifth and last set of pins as a gasified fuel or molecular fuel thereby, exposing each molecule of fuel to molecules of air (oxidizer) to provide complete combustion of the fuel. At this point, the fuel molecules will be completely wrapped in oxygen molecules. Gasified or super heated fuel provides the greatest opportunity for each molecule of fuel to combine with molecules of oxygen, thus allowing substantially complete combustion to be achieved with maximum energy liberation.

Still referring to FIG. 5, the mounting/adaptor plate 29 for the motor and the fuel nozzles 22 has seventy two (72) 1/16" holes drilled through it to allow air from the pressurized air chamber to enter the gasification unit in parallel with the fuel from the fuel nozzles 22, 22*a* that penetrate the mounting plate 29 and extends 1/4" to 3/8" below the plate 29.

This fuel and air mix passes through all five stages of the gasification unit, with additional air being added through the thirty six additional holes 30 in the first three (3) steps of the stator 26 housing. (See FIG. 6 which shows additional holes and the pins in intermeshing arrangement from the button or exit end of the gasification unit. A cross-section of FIG. 6 is shown in FIG. 7.)

Those skilled in the art will recognize that rows of stationary and rotating pins can be added or deleted, ports can be added or deleted and the stator and rotor can be reduced or enlarged in size and shape and rotational speed, for the turbine engine, or combustion chamber, can be increased and decreased for the engine that it is designed to fuel. Also, the fuel and air volumes, temperatures and pressures will vary for each engine or combustion chamber and the materials required for fabrication will vary in weight and type of material and shape as these which are influenced by operating temperature, altitude of operation, type of fuel and oxidizer for each engine application.

In FIG. 5, the combustion chamber 32 is shown with the fuel gasification unit 21 mounted on firewall 33 and referring now specifically to FIG. 5, the fuel nozzles 22, 22*a* each inject liquid fuel into a 180 degree arc, on each side of the rotating sleeve 23, each providing a one-half of a conical shape fuel spray. When combined together the nozzles will provide a full 360° arc that will be an ever enlarging cone shape, complimenting the stator cone shape. Thus, with the turbulence of the rotor pins being enhanced by the stator pins, the fuel is thoroughly gasified and mixed with the air.

Third Preferred Embodiment

FIG. 8 shows the assembly of a set of four gasification units 41 that have been inserted between the intake ports P and injector 42 for a four-cylinder engine. Mounting plate 45 secures the lower end of gasification units 43 and is aligned with the valve intake ports P in the engine head. Motor mounting plate 46 carries motors 48 and air intake housings 49 which surround and protect motor 48. These housings are provided with openings to admit air or alternately may be provided with forced or compressed air from a compressor. Original intake manifold 44 is modified to adapt and secure plate 44. This allows the fuel injectors to remain substantially in their respective O.E.M. locations. This arrangement allows all of the air A for each cylinder to go through each gasification unit 41 with the fuel being injected into each air stream before the air streams enter the gasification units. Thus, the fuel becomes gasified and mixed with the air simultaneously before entering the valve head intake ports P.

Here, the gasification unit becomes an integral part at the air/fuel premixing process, providing a homogeneous mixture of gasified fuel as it enters the valve intake chamber. This arrangement allows the EGR (Exhaust Gas Recirculation) valves to function as they normally do. With the gasification units now in the main air stream, oxygen molecules in the air can readily combine with each gasified fuel molecule being more completely homogeneous mixes before entering the combustion chamber. Also, the vacuum that is present in the air stream further enhances the fuel gasification process by lowering the fuel droplets surface tension making it easier to break open the fuel droplets.

An air stream straightening vane can be inserted at the exits of the gasification units to eliminate vortexing or cavitation in the valve head mix chamber, if necessary. In this embodiment, the gasification unit motors are installed directly upstream in the intake manifold. Air motors may be used in this embodiment.

In my invention, the gasification units are an integral part of the fuel/air mixing and delivery processes. The manifold and valve head mounting plates have the gasification units sandwiched between them. The existing bolts attaching the O.E.M (Original Equipment Manufacture) manifold to the valve head ports are lengthened to facilitate holding the O.E.M. manifold plate with the gasification assemblies 41 being disposed between plates 45 and 46 with minimal or no modification to the OEM equipment.

This embodiment can be used with minor modifications to the gasification unit assembly and with adaptations as required to each configured engine intake manifold regardless of the number of cylinders or whether it is for marine, aircraft, or land based engine applications. Also, the gasification unit can be adapted to straight in-line, V, radial, engine configurations.

The gasification unit of my invention provides fuel that has been reduced substantially to its molecular level and each fuel molecule when mixed with molecules of air, the fuel molecule is essentially wrapped in air molecules and will burn virtually all of the fuel, giving more power to the engine, better fuel efficiency and due to a more complete burn with more environmentally acceptable combustion emissions.

Although preferred embodiments of my invention have been discussed in detail, other embodiments of my invention may be developed by those skilled in the art after reading and understanding my foregoing specifications. However, my invention is only limited by the scope of the claims which follow.

What is claimed is:

1. A method for mechanically converting of a liquid fuel for an internal combustion engine to a substantially gaseous state comprising the steps of:

a) providing atomized fuel in fine droplets;

b) passing said atomized fuel through a plurality of intermeshing sets of rows and columns of pins;

c) rotating at least one set of pins at high speed as the atomized fuel passes therethrough; and, d) directing said fuel into the combustion chamber of the internal combustion engine.

2. The method of claim 1 including the step of providing said atomized fuel from a fuel injector.

3. The method of claim 1 wherein said one of said set of pins is rotated in the range from about 10,000 rpm to about 100,000 rpm and in the intermeshing pins are at a clearance of about 0.020 inches.

4. The method of claim 1 wherein said internal combustion engine has a multiplicity of cylinders and in step (d) the fuel is directed into the combustion chamber of each cylinder.

5. A method of mechanically converting gasoline and like fuels from a liquid to a substantially gaseous state comprising the steps of:

a) providing gasoline in an atomized state;

b) providing a generally cylindrical housing having disposed therein a cylindrical stator with an array of pins projecting inwardly from the interior wall of said housing, said pins being arranged in columns and rows;

c) providing a generally cylindrical rotor with an array of pins extending outwardly from its outer surface in rows and columns corresponding to the pins on said stator, said rotor being mounted with said stator for high speed rotation about it vertical axis, said rotor pins being mounted so that upon rotation of the rotor respective rows of rotor pins between respective rows of stator pins;

d) providing a motor capable of rotating said rotor at high rotational speeds in the range from below 10,000 to above 100,000 rpm;

e) positioning said rotor within said stator for rotary motion driven by said motor to form a fuel gasification assembly; and, f) mounting said assembly on an automobile engine to receive atomized fuel from a fuel injector and to deliver substantially gasified fuel directly into the intake manifold and into said engine; and, g) rotating said rotor at a high speed while passing atomized or liquid fuel therethough; said fuel being subsequently delivered to said intake manifold.

6. The method of claim 5 wherein said atomized fuel is provided by a fuel injector.

7. The method claim 5 wherein said atomized fuel is provided by a carburetor.

8. A method of mechanically converting atomized liquid fuel to a gaseous state comprising the steps of:

a) rotating a first set of pins within a intermeshing second set of pins, the clearance between the longitudinal surfaces of said pins being about the range from about 0.01 inches to about 0.060" inches or less, and said pins being rotated in the range of below 10,000 to greater than 100,000 rpm;

b) passing atomized fuel through said stator pins whereby said atomized fuel droplets are mechanically substantially gasified; and, c) delivering said gaseous fuel to the intake port of an internal combustion engine.

9. The method of claim 8 wherein the first set of pins are rotating and the second set of pins are stationary or counter-rotating.

10. The method of claim 8 wherein the second set of pins counter-rotate with respect to the first.

11. An apparatus for mechanically gasifying atomized liquid fuel comprising:

a) a housing;

b) a stator body disposed within said housing, the inner surface of said stator body having an array of pins inwardly projecting therefrom;

c) a rotor body having an array of pins outwardly projecting from the outer surface thereof;

d) means for mounting said rotor for high speed rotary motion with its pins intermeshing with the stator pins;

e) a drive motor for rotating the rotor at high speeds;

f) a first end closure means adapted to close the housing at one end thereof and for receiving atomized fuel from an injector and for passing said atomized fuel into said housing, said first closure means supporting said motor and being mounted so that the motor can drive the rotor; and, g) a second end closure means said for closing the other end of said housing and for directing gaseous fuel that emerges from said rotating pins to the intake manifold of an internal combustion engine.

12. The apparatus of claim 11 including means for mounting said stator in a stationary position with respect to the rotor and further including drive means for counter rotating said body.

13. The apparatus for claim 12 wherein the apparatus of claim 8 comprises a first stage of gasification and including a second stage substantially identical to the first stage, the stator, rotor, and housing of the second stage each having a greater diameter than in the first stage.

14. The apparatus of claim 11 wherein said second closure means is adapted for directing gaseous fuel to an intake manifold which conveys said fuel to the intake valves.

15. The apparatus of claim 11 wherein the stator body has a stepped inner diameter with the diameter increasing from top to bottom of said stator, with each step being of sufficient height to accommodate a row of stator and rotor pins, said rotor and stator pins being selected so that their lengths extend operably across each step.

16. The apparatus of claim 11 wherein the stator and rotor pins each have a flat side, said flat side facing the discharge end of said apparatus.

17. The apparatus of claim 11 wherein said apparatus is installed on an internal combustion engine having an intake manifold and intake vales and parts; and, a) said first closure means is a motor mounting plate secured to the intake manifold of said internal combustion engine adapted to receive said apparatus; and, b) said second closure means is a mounting plate positioning the apparatus over the intake valve port whereby said gaseous fuel is directed to the valve port.

18. The apparatus of claim 11 wherein said pins have a round cross section.

19. The apparatus of claim 11 wherein at least one pin has a generally propeller-like twist in its longitudinal extension.

* * * * *